US006390934B1

(12) United States Patent
Winfield et al.

(10) Patent No.: US 6,390,934 B1
(45) Date of Patent: May 21, 2002

(54) METHOD OF IMAGE PROCESSING OF PAINT DOTS ON GOLF BALLS

(75) Inventors: Douglas C. Winfield, Seneca, SC (US); William Gobush, North Dartmouth; Diane Pelletier, Fairhaven, both of MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 09/821,629

(22) Filed: Mar. 29, 2001

(51) Int. Cl.[7] ..... A63B 37/00
(52) U.S. Cl. ..... 473/351; 32/169
(58) Field of Search ..... 473/125, 131, 473/156, 140, 141, 198–200, 220–226, 351, 152, 409; 382/106, 169–172, 295

(56) References Cited

U.S. PATENT DOCUMENTS

| | | | | |
|---|---|---|---|---|
| 4,063,259 A | | 12/1977 | Lynch et al. | 354/120 |
| 4,136,387 A | | 1/1979 | Sullivan et al. | 364/410 |
| 4,137,566 A | | 1/1979 | Haas et al. | 364/410 |
| 4,158,853 A | | 6/1979 | Sullivan et al. | 358/93 |
| 4,375,887 A | | 3/1983 | Lynch et al. | 273/32 |
| 5,342,051 A | * | 8/1994 | Rankin et al. | 473/199 |
| 5,471,383 A | | 11/1995 | Gobush et al. | 364/410 |
| 5,501,463 A | | 3/1996 | Gobush et al. | 273/184 |
| 5,575,719 A | | 11/1996 | Gobush et al. | 473/223 |
| 5,803,823 A | | 9/1998 | Gobush et al. | 473/223 |
| 6,042,492 A | * | 3/2000 | Baum | 473/453 |
| 6,320,173 B1 | * | 11/2001 | Vock et al. | 250/206.1 |

* cited by examiner

*Primary Examiner*—Joe H. Cheng
*Assistant Examiner*—Kim T. Nguyen
(74) *Attorney, Agent, or Firm*—William B. Lacy; Troy R. Lester

(57) ABSTRACT

A method of automatically calculating the spatial relationship of a plurality of diffuse dots on a ball, comprising the automated steps of obtaining at least two ball images of the ball at two or more discrete times; calculating a first gray level of the image; smoothing and binarizing the image; locating and determining the number of ball images in the image; locating and determining the number of diffuse dots on each ball image; confirming that the calculated number of dots equals a predetermined number of dots on each ball image; and calculating movement characteristics of the ball.

13 Claims, 6 Drawing Sheets

METHOD OF IMAGE PROCESSING OF PAINT DOTS ON GOLF BALLS

FIELD OF THE INVENTION

The Application is generally directed to a novel method for image processing of printed dots on spherical objects and, more specifically, diffusely-reflective dots, such as painted dots, on golf balls.

BACKGROUND OF THE INVENTION

Apparatus for measuring the flight characteristics of spherical objects, such as golf balls, are known in the art. Methods for detecting golf club head position and golf ball position shortly after impact using photoelectric means to trigger a flash to permit a photograph to be taken of the club head have been disclosed in U.S. Pat. Nos. 4,063,259; 4,158,853, and 4,375,887, which are incorporated in their entirety herein by reference. Golf ball or golf club head movement has been determined by placing reflective areas on a golf ball and determining their position with electro-optical sensors, such as disclosed in U.S. Pat. No. 4,136,387. The use of electro-optical sensing of light sources, on both a golfer's body and a golf club, and apparatus for monitoring a golfer and a swinging golf club has been disclosed in U.S. Pat. No. 4,137,566.

One troublesome aspect of the most successful systems currently in use for measuring golf ball flight characteristics is the required use of strobe illumination of reflective dots adhered to specific locations on a golf ball. Examples of such systems are disclosed in U.S. Pat. Nos. 5,471,383; 5,501,463; 5,575,719; and 5,803,823, which are incorporated in their entirety herein by reference. These systems generally require cameras, sensors, and strobe lights positioned to illuminate the golf ball, and thus the reflective dots, at two different times immediately after impact with a golf club. The images of the reflective dots are subsequently analyzed—from the changes in the relative positions of the reflected images, as a function of time, a number of golf ball flight characteristics, such as ball velocity, launch angle, side angle, and spin rate, may be calculated. While the illumination of reflective dots has proved to be a successful method for attaining ball flight characteristics, in many cases this method does not provide a true measure of the actual ball flight characteristics. Adhering reflective dots to the surface of a golf ball can affect the ball flight characteristics in a negative way. The reflective dots are usually thick, thereby providing raised protrusions on the ball surface. As such, the raised dots impart asymmetry to the lift and drag and differing backspin and sidespin are imparted on the ball, all of which affect ball trajectory and, therefore, distance. Further, it is difficult to repeatably attach the reflective dots in precise locations, as they are attached adhesively onto a dimpled surface.

One area that has not been adequately addressed by past golf ball launch monitoring systems relates to the image processing of diffuse markings, such as paint or ink dots on golf balls, to obtain golf ball flight characteristics. Paint or ink dots may be applied thin enough that no measurable distortion in trajectory is observed. While replacing reflective tape dots with ink dots eliminates the aforementioned flight characteristic problems, analyzing gray-scale images of golf balls in order to obtain the locations of paint dots on a golf ball presents a unique image processing problem, especially when the ball is in flight and multiple strobe flashes are used. Therefore, it would be useful to develop a method in which one could automatically identify, and determine the position of, diffuse paint from an optical image in a straightforward manner without significant input from the user or golfer.

SUMMARY OF THE INVENTION

The present invention is directed to a method of automatically calculating the spatial relationship of a plurality of diffuse dots on a ball, comprising the automated steps of obtaining at least two ball images of the ball at two or more discrete times; calculating a first gray level of the image; smoothing and binarizing the image; locating and determining the number of ball images in the image; locating and determining the number of painted dots on each ball image; confirming that the calculated number of dots equals a predetermined number of dots on each ball image; and calculating movement characteristics of the ball.

In one embodiment, the first gray level is calculated using an iterative selection algorithm. Preferably, the step of locating and determining the number of ball images in the image further comprises determining a boundary of the ball images in the image and calculating a region of interest around each boundary. Additionally, the step of determining the boundary of the balls in the image further comprises a contour following or a boundary chain algorithm. Preferably, the region of interest is rectangular.

In another embodiment, the step of locating and determining the number of diffuse dots on each ball images further comprises the steps of isolating the region of interest; inverting the image; and calculating a second gray level to provide a threshold value. In still another embodiment, the step of determining the number of diffuse dots on each ball image further comprises the steps of identifying at least one discrete object within the image using a contour tracing or a boundary chain algorithm; calculating an area, a centroid, and an aspect ratio for each discrete object in the region of interest; and filtering the objects based on the area and aspect ratio.

The step of determining a gray level the calculated number of dots equals the predetermined number of dots on each ball image preferably further comprises using a Golden Mean algorithm. In one embodiment, the characteristics of the ball comprise magnitude of velocity, direction of velocity, magnitude of spin, direction of spin. In another embodiment, the direction of velocity is defined as angles relative to an orthogonal gravity oriented coordinate system. In yet another embodiment, the direction of spin is defined as components of spin about an orthogonal axis system.

The dots should have a thickness of less than about 0.001 inches and are, preferably, pad printed or inkjet printed on the ball.

DESCRIPTION OF THE PREFERRED EMBODIMENT

Figure 1:
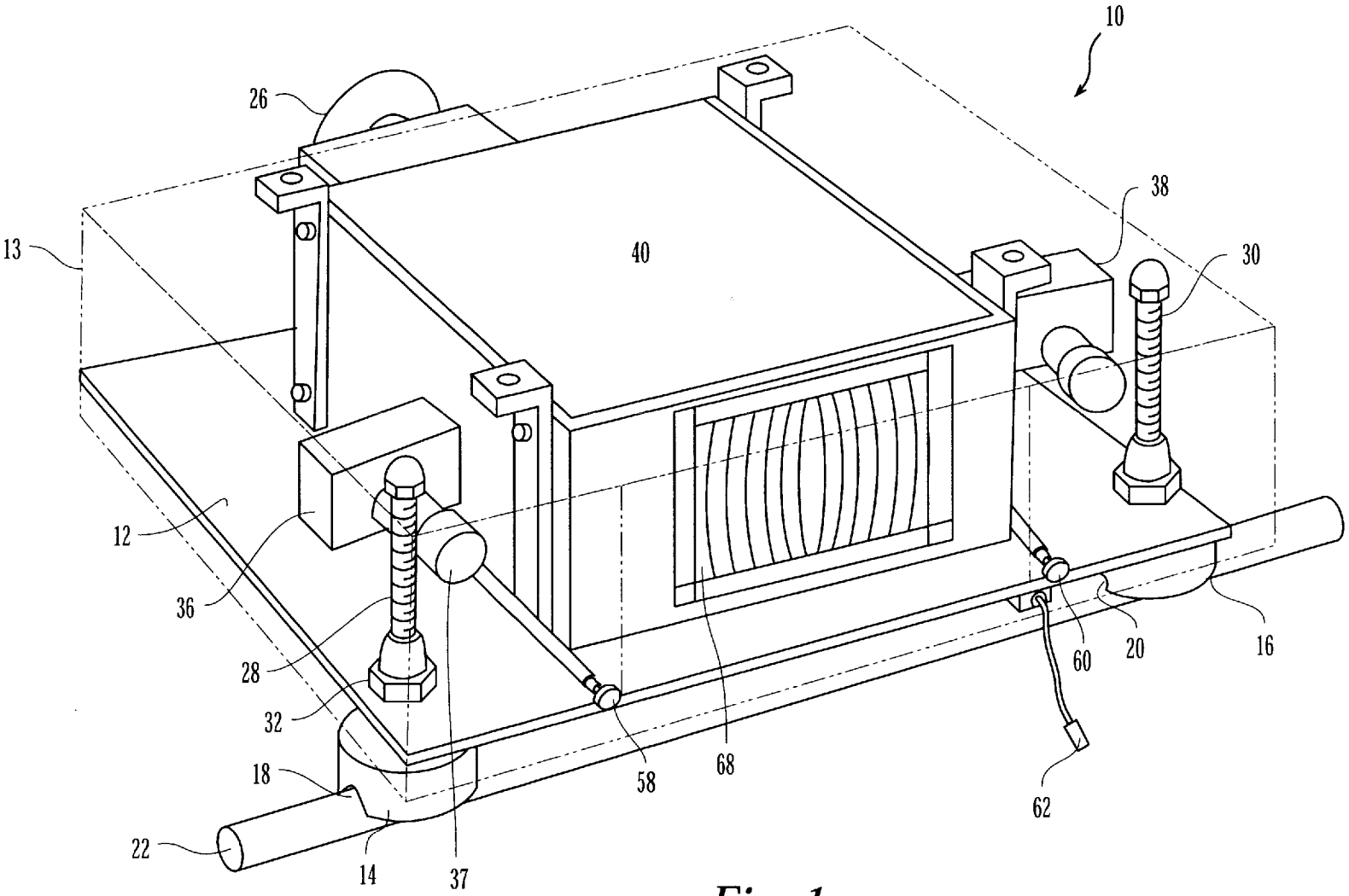
FIG. 1 is a is a perspective view of the launch monitor of the present invention.
Figure 2:
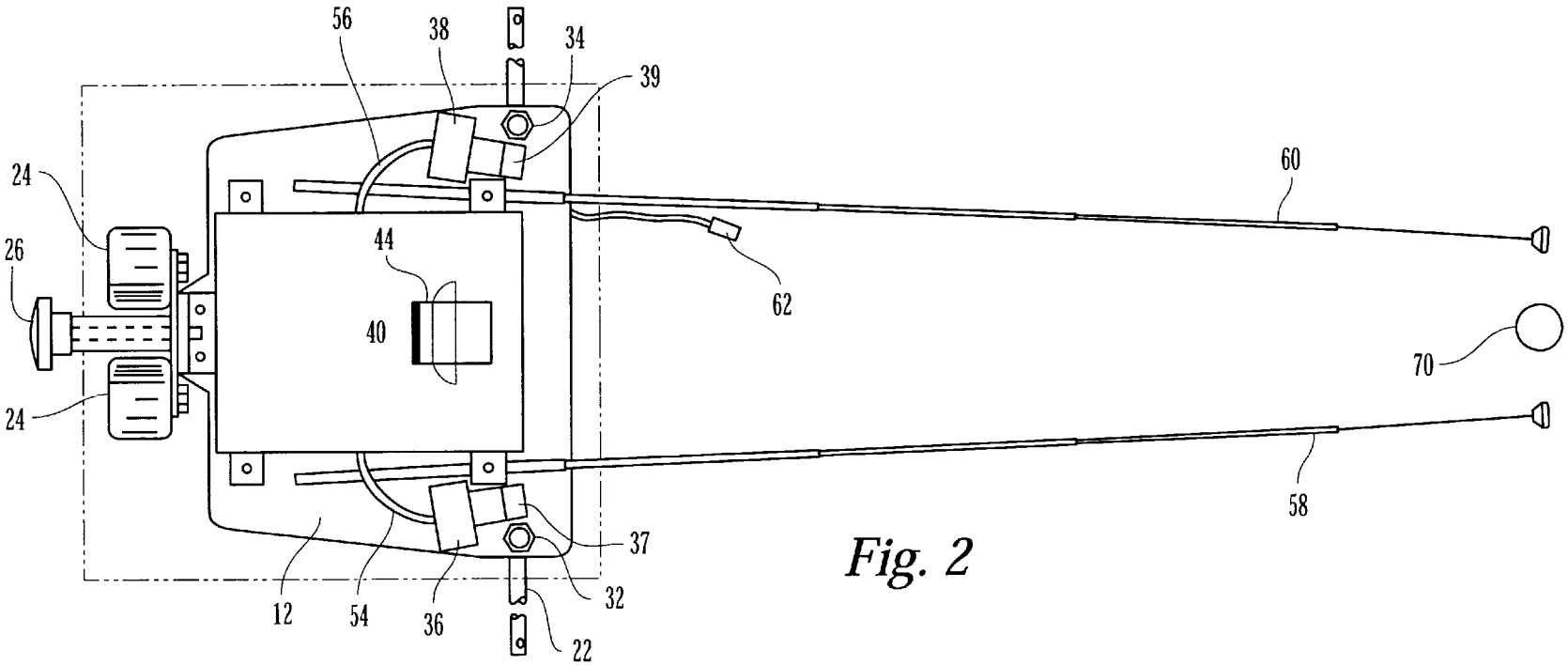
FIG. 2 is a is a top view of the launch monitor shown in FIG. 1.
Figure 3:
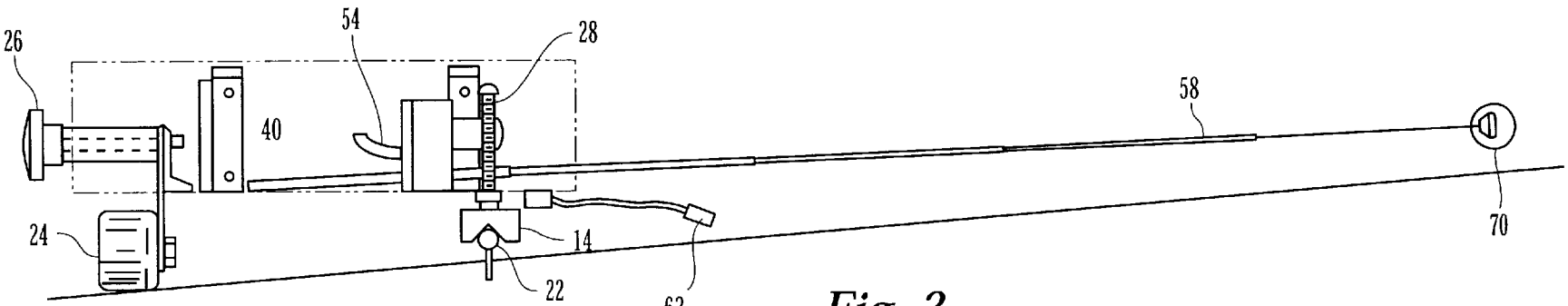
FIG. 3 is a is a side elevational view of the monitor shown in FIGS. 1 and 2.

Referring to FIGS. 1–3, launch monitoring system 10 generally includes a base or support structure 12 that may also have a cover 13. Slide members or pads 14, 16 are utilized at a lower front portion of support structure 12 and include notches 18, 20 for receiving a rod 22 along which pads 14, 16 may slide. As shown in FIGS. 2–3, wheels 24 may be attached for rotation and to support structure that includes a handle 26 for allowing an operator to move launch monitoring system 10 back and forth along the ground. This embodiment also includes threaded rods 28, 30 and respective nuts 32, 34 for allowing height adjustment at the front of launch monitoring system 10. The wheels may also be height adjusted relative to the support 12 to allow the system 10 to be adjusted depending on the terrain on which the system is placed. Although not shown, the launch monitor system is attached to a computer and for subsequent analysis and image processing. The computer and monitor may be combined into a single element or be separate elements. The computer has several algorithms and programs used by the system to make the determinations discussed below.

The launch monitoring system 10 further includes first and second camera units 36, 38, a centrally disposed control box 40, and a dual strobe lighting unit. First and second camera units 36, 38 are preferably ELECTRIM EDC-1000U Computer Cameras from Electrim Corporation in Princeton, N.J. Charge-coupled device ("CCD") cameras are preferred but TV-type video cameras are also useful. CCD's are two-dimensional silicon-metal oxide arrays that are nearly ideal for a variety of imaging needs, especially those requiring detection at low light levels, such as those presented herein due to the lack of reflective dots.

CCD detectors have a number of characteristic advantages over other multichannel detectors, such as photomultiplier tubes, including high quantum efficiency in the visible spectrum, excellent charge-transfer efficiency, low read noise and dark current, wide dynamic range, and image plane stability. Utilization of the CCD as a detector is based on collecting and storing photon-induced charge on a continuous silicon substrate divided into individual elements (pixels) by a series of electrodes which are used to manipulate the charge. Exposure of this two-dimensional imaging area leads to charge accumulation that is localized by potential wells established by electrodes on the detector surface. This charge "image" can be propagated row-by-row across the CCD to a serial register by a series of potentials applied to the electrodes. Once the entire array is emptied of charge, the image is reconstructed on a monitor for viewing by the user.

Figure 4:
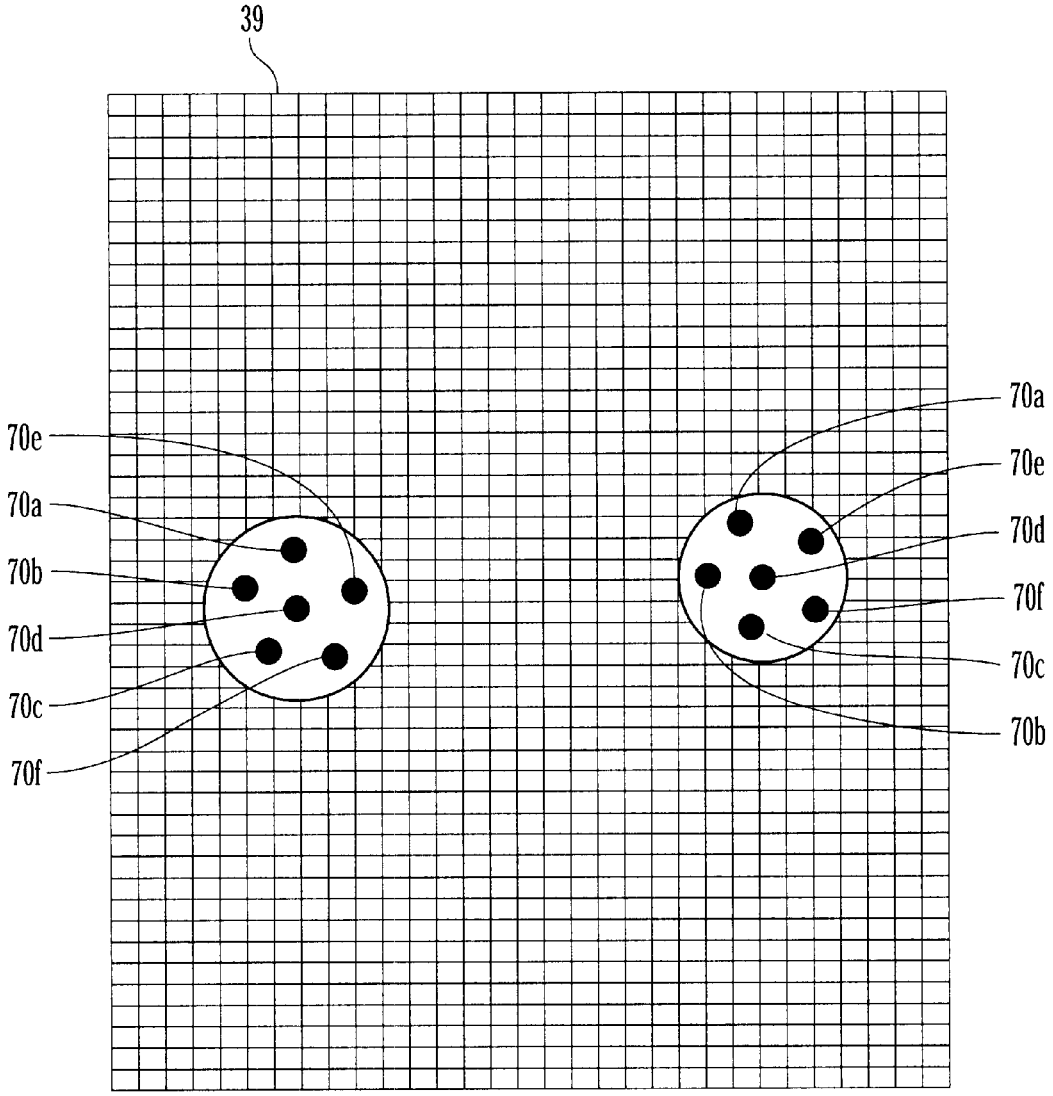
FIG. 4 is an elevational view of the light receiving and sensory grid panel located in each camera within the monitor.
Figure 6:
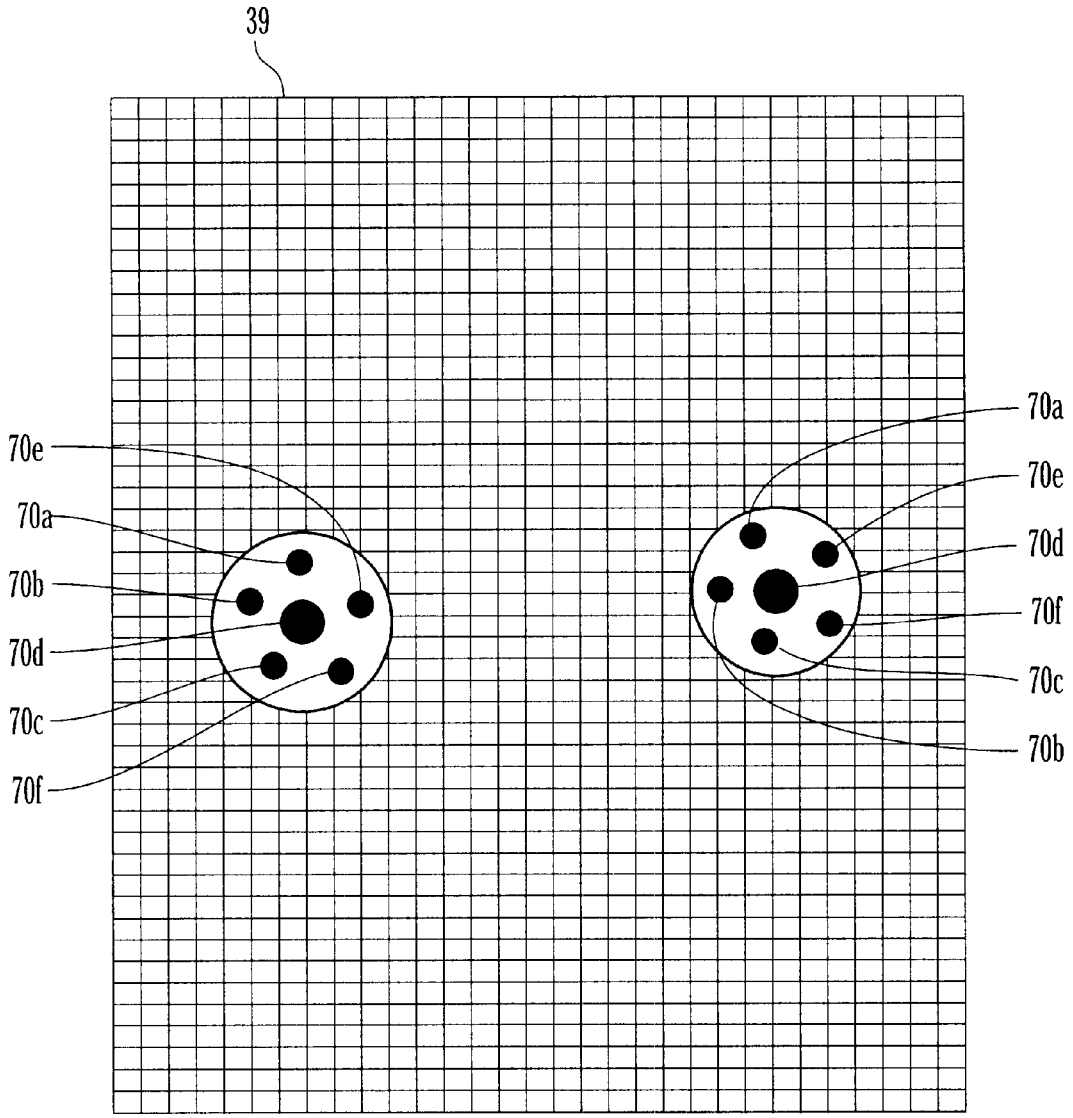
FIG. 6 is an elevational view of the light receiving and sensory grid panel located in each camera within the monitor for a preferred embodiment.

The cameras 36, 38 each have a line-of-sight directed to and focused on a predetermined focal length. The focal length of the cameras is larger than required to image a single golf ball. The angle between the line of sight of the two cameras is preferably in the range of about 10° to about 30°, with about 22° being most preferable. Each of the cameras 36, 38 has a light-receiving aperture, shutter, and light sensitive silicon panel 39 (see FIGS. 4 and 6, showing a silicon panel, which also generally corresponds to an image captured by the cameras and used by the system). The cameras are directed and focused on a predetermined field-of-view in which a golf ball moves and is imaged.

A control box 40 is provided and includes a strobe light unit at a front portion thereof. As shown in FIG. 2, strobe light unit is comprised of a single flash bulb assembly 44, the related circuitry, and a cylindrical flash tube. The operation of which are described in more detail in U.S. application Ser. No. 09/537,295, which is incorporated in its entirety herein by reference. Video lines 54, 56 from the respective electro-optical units 36, 38 lead to control box 40. Distance calibrators, such as antennas 58, 60, and a microphone 62, are used to aid in calibration and initiation of the launch monitor system.

Referring to FIG. 2, the use of a single flash bulb assembly 44 and associated circuitry in the strobe light unit increase the portability of the launch monitor. In another embodiment, however, a dual strobe assembly is acceptable. The strobe light unit has a single flash bulb assembly 44 capable of flashing faster than every 1000 $\mu$s (1000 Hz). The circuits used with the strobe light unit are the subject of application Ser. No. 09/008,588, now U.S. Pat. No. 6,011,359, which is incorporated herein in its entirety by reference.

To increase the amount of light directed to the golf ball, an optical or Fresnel lens is inserted at the front of the control box 40, placed in front of the flash bulb assembly 44, as shown in FIGS. 1 and 2. The Fresnel lens has a collimating effect on the light from a cylindrical flash tube. Thus, light pattern with the Fresnel lens controls the dispersion of light. The lens preferably has a focal length of about 3 in, and the center of the flash bulb assembly 44 is less than 3 in behind the lens. This arrangement allows the system 10 to have a smaller flash bulb assembly 44 than without the lens because the collimation of the light increases the flux of light at the golf ball in the predetermined field-of-view. This increase in the flux allows using non-reflective materials as well as the use of the system in brighter lighting conditions, including full-sun daylight.

As described in U.S. application Ser. No. 09/537,295, a calibration fixture is provided to calibrate the system. Distance calibrators 58, 60, determine the proper location for a golf ball 70 used in a launch monitoring operation, as shown in FIGS. 2 and 3. Golf ball 70 also has the pattern of painted dots as shown in FIGS. 5 and 7.

Figure 5:
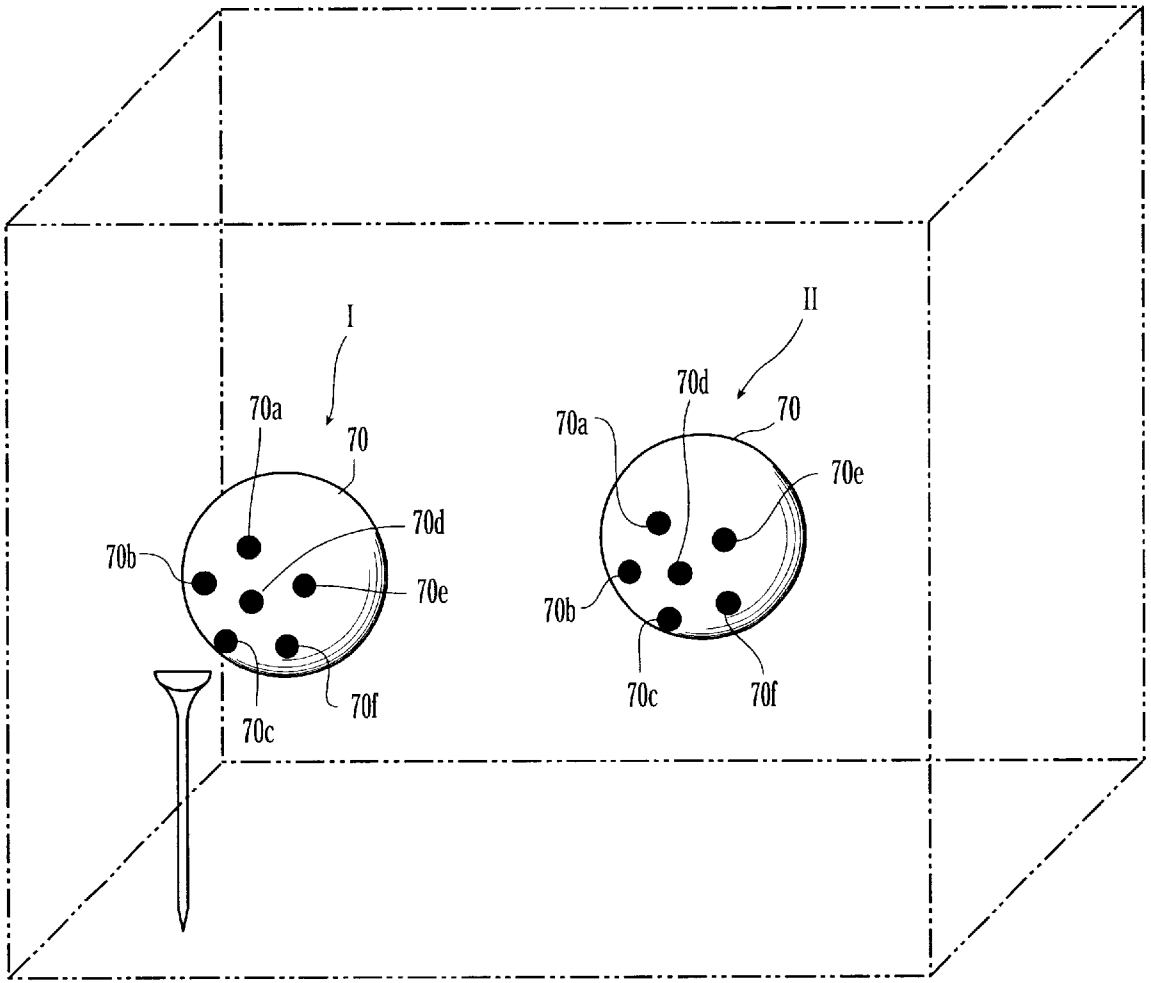
FIG. 5 is a perspective view of a three-dimensional rectilinear field showing a golf ball at two different positions I and II.
Figure 7:
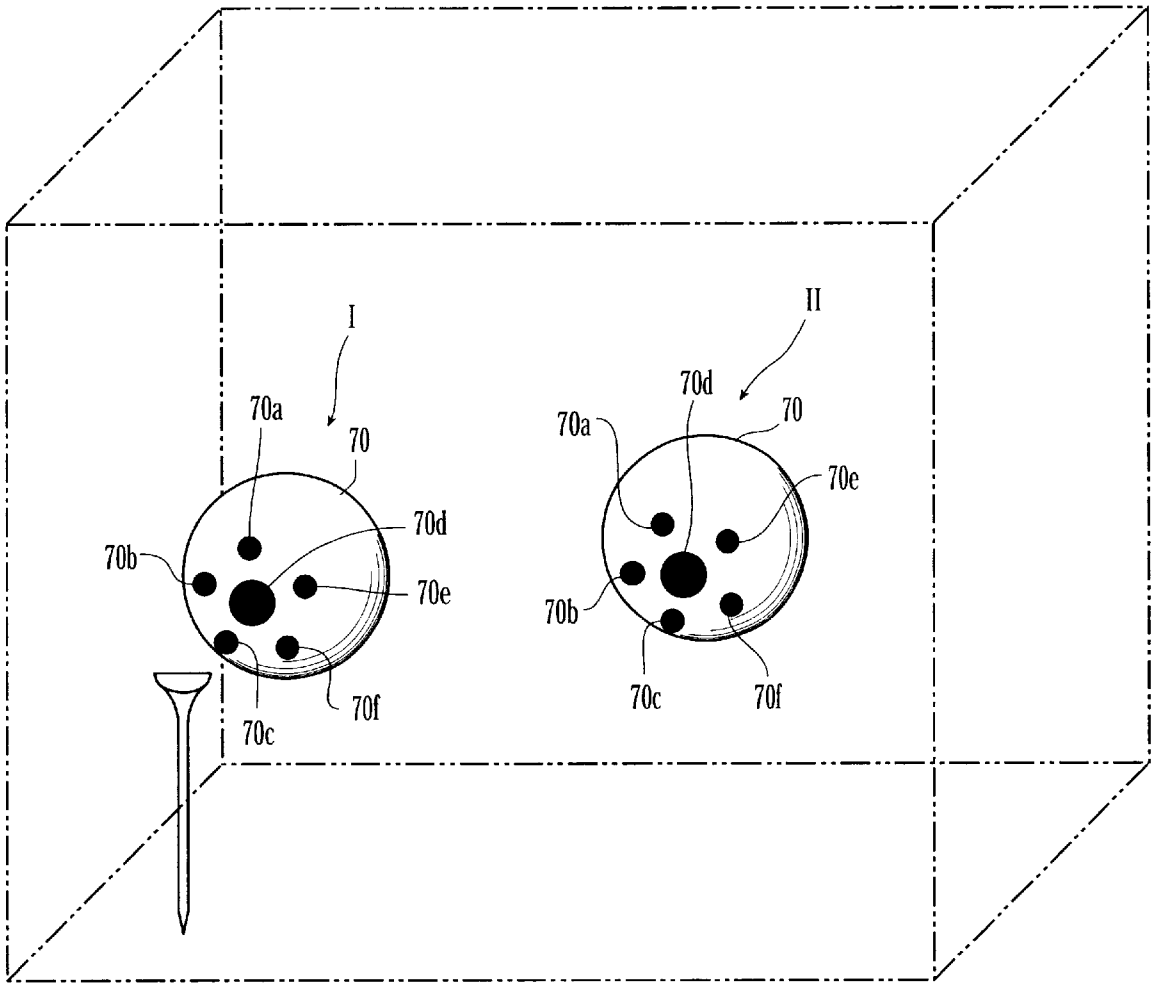
FIG. 7 is a perspective view of a three-dimensional rectilinear field showing a golf ball at two different positions I and II for a preferred embodiment.

As shown in a three-dimensional, predetermined, rectilinear field-of-view (shown in phantom) in FIGS. 5 and 7, golf ball 70 has painted, discrete areas or dots 70*a–f* placed thereon. The preferred diameters of the round dots 70*a–f* range from about 0.1 to about 0.125 in, but other sized and shaped areas can be used. The dots 70*a–f* may be any printed matter that define contrasting areas, such as inks, dyes, and paints, however, it is preferred that the dots are printed on the golf ball surface using, for example, an inkjet printer system or ink and a pad printing system. Pad printing is well-known in the art and is commonly used to apply logos or indicia to golf ball surfaces. The number of dots should be at least three, and preferably, at least six. In a more preferred embodiment, the painted dots are arranged in a pentagonal 6-dot pattern in which 5 dots form the nodes of a pentagon and contain a single dot centered within. In the most preferred embodiment, the painted dots are arranged in a pentagonal 6-dot pattern, with the center dot being larger than the others (See FIG. 7, dot 70*d*). Preferably, the thickness of the diffuse dot ink or paint is less than 0.001 in. Thicknesses greater than this negatively affect ball flight.

Referring to FIGS. 5 and 7, golf ball 70 is shown in two positions I and II to illustrate the preferred embodiment, corresponding to the locations of the golf ball 70 when imaged by the system. In positions I and II the golf ball is shown after being struck. The image taken at position I occurs at a first time and the image taken at position II occurs at a second time, just after the first time. As a result of the positioning of the cameras 36, 38 and the dots 70*a–f*, both cameras 36 and 38 are capable of imaging the dots 70*a–f*, which initially appear as black areas 70*a–f* on the detector 39 (as shown in FIGS. 4 and 6) and the corresponding image.

Prior to operation with a golfer, the launch monitor system must be calibrated to define the appropriate coordinate system, be set up for either the left- or right-handed orientation, depending on the golfer to be tested, and set up as either a test or a demonstration. In test mode, the system saves accumulated data for each golfer, whereas in demonstration mode the system does not save any data.

Additional data specific to the location of the test and the golfer is entered as well, such as temperature, humidity, wind speed and direction, elevation, and type of turf. The operator may input the personal data of the golfer if desired, such as handicap, golf ball type (for use in trajectory calculations), and golf club used (type, club head, shaft).

After this data is entered, the system is ready for use. Generally, the system waits for a sound trigger from the microphone 62. When the sound trigger (generally the club striking the ball) is above a predetermined sound threshold, the launch monitor system is triggered to capture two images of the golf ball and painted dots (as shown in FIGS. 4 and 6), separated by a short time interval. The time interval can be any interval, however, it is typically 800 $\mu$s. The two images are attained with the two cameras 36, 38 and recorded on the detector 39, typically a CCD. These two images are used by the system to determine the flight characteristics of the golf ball.

The launch monitor system uses several algorithms stored in the computer to determine the location and orientation of the golf ball in each of the two images. Spatial comparison of the dots and the relative changes of the dots between the two images allow calculation of a number of golf ball performance characteristics. Because painted dots provide different (low light) images as compared to reflective dots, they are challenging to discern, analyze, and filter and as such, require different algorithms and image analysis methodology to properly determine golf ball flight characteristics. Determining the velocity and spin characteristics of the golf ball by analyzing the two images containing painted dots is preferably accomplished without any user input or decision-making.

The first step is to identify the areas in the raw image that contains the golf balls. This step is accomplished through a variety of binarizing, smoothing, and isolation algorithms. First, the raw images are analyzed to determine the gray level threshold. This step may be accomplished by calculating gray level (gray level segmentation) using, for example, an iterative selection type algorithm on the entire image. Iterative selection is a process in which an initial guess at a threshold is refined by consecutive passes through the image. It does not use the histogram, but instead thresholds the image into object and background classes repeatedly, using the levels in each class to improve the threshold. Therefore, the various gray levels are analyzed and assigned, based on a predetermined gray level threshold, either "white" or "black."

Once the images are in black and white, they are dilated and eroded to smooth the background noise contained in the images. Any number of algorithms known to one skilled in the art may be used to smooth the noise. Preferably, the images are dilated and eroded at least about 3 times and, more preferably, about 3 to about 5 times. Additionally, the images are thresholded at a predetermined gray level to obtain a binary image.

A different algorithm is used to determine the boundary of the area in each image that pertains to each golf ball (the "white" area with "black" painted dots). The golf ball boundary is distinguished from the rest of each image by determining the boundary pixels of all of the white binary large objects ("blobs") and calculating the rectangular region of interest ("ROI") containing each blob and the area of the rectangular ROI. Preferably, the algorithms comprise contour following and boundary chain algorithms and, more preferably, the algorithm used to calculate the ROI is a contour following algorithm. Finally, the image is filtered to remove any extraneous "bright" areas, such as reflections from the golf club, the golfer, and other objects nearby.

Second, after the golf ball regions are identified, smoothed, and binarized, the blobs are isolated, i.e., separated from the remaining area of the images. This step is comprises a number of algorithms and is preferably a looping step that iterates at least 1 time for each golf ball (blob) automatically found. While the blobs in the image may be analyzed from the same image, it is preferred that the balls are analyzed separately. For each of the blobs found by the above steps of algorithms, the ROI is isolated. Once isolated, the ROI containing a single blob (golf ball) is inverted, i.e., the ball becomes "black" and the dots and background become "white." The inverted ROI is analyzed using an iterative selection type algorithm to calculate a gray level. The algorithm iterates on gray level until the number of dots identified equals the number of dots painted on the ball. Preferably, the gray level is different than the first gray level calculated as described above. Effectively, using an iterative selection type algorithm to calculate the gray level of the ROI, which defines a dot, increases the dynamic range and, therefore, the sensitivity of the ROI. Again, the ROI is thresholded at the calculated gray level to obtain a binary image. Examples of suitable thresholding methods include two peaks, mean value, iterative selection, GLH, Pun, Kapur, Johannsen, X percent, Fuzz (entropy), Fuzz (Yager), and minimum error methods. Preferably, the ROI is thresholded using a two peaks, iterative selection, or X percent method and, more preferably, the X percent method, where the value of X is to be determined by the algorithm.

Using a different algorithm, such as a marking, connected component marking, or a connected algorithm, the blob is identified and its area, centroid, and aspect ratio are calculated. The blobs are then filtered with respect to area and aspect ratio to identify the paint dots from the background and other extraneous objects. Preferably, if the number of dots located does not equal the number of dots known to be on the ball, the iteration scheme uses a Golden Mean algorithm, to determine the appropriate gray level such that it is at a level sensitive enough to find all painted dots.

The term "about," as used herein in connection with one or more numbers or numerical ranges, should be understood to refer to all such numbers, including all numbers in a range.

The invention described and claimed herein is not to be limited in scope by the specific embodiments herein disclosed, since these embodiments are intended solely as illustrations of several aspects of the invention. Any equivalent embodiments are intended to be within the scope of this invention. Indeed, various modifications of the invention in addition to those shown and described herein will become apparent to those skilled in the art from the foregoing description. Such modifications are also intended to fall within the scope of the appended claims.

What is claimed is:

1. A method of automatically calculating the spatial relationship of a plurality of diffuse dots on a ball, comprising the automated steps of:

(a) obtaining at least two ball images of the ball at two or more discrete times;

(b) calculating a first gray level of the image;

(c) smoothing and binarizing the image;

(d) locating and determining the number of ball images in the image;

(e) locating and calculating the number of diffuse dots on each ball image;

(f) confirming that the calculated number of dots equals a predetermined number of dots on each ball image; and (g) calculating movement characteristics of the ball.

2. The method of claim 1, wherein the first gray level is calculated using an iterative selection algorithm.

3. The method of claim 1, wherein the step of locating and determining the number of ball images in the image further comprises:

(a) determining a boundary of the ball images in the image; and (b) calculating a region of interest around each boundary.

4. The method of claim 3, wherein the step of determining the boundary of the ball images in the image further comprises a contour following or a boundary chain algorithm.

5. The method of claim 3, wherein the region of interest is rectangular.

6. The method of claim 1, wherein the step of locating and determining the number of diffuse dots on each ball image further comprises the steps of:

(a) isolating a region of interest;

(b) inverting the image; and (c) calculating a second gray level to provide a threshold value.

7. The method of claim 1, wherein the step of determining the number of diffuse dots on each ball image further comprises the steps of:

(a) identifying at least one discrete object within the image using a contour tracing or a boundary chain algorithm;

(b) calculating an area, a centroid, and an aspect ratio for each discrete object in a region of interest; and (c) filtering the objects based on the area and aspect ratio.

8. The method of claim 1, wherein the step of confirming that the calculated number of dots equals the predetermined number of dots on each ball image further comprises using a Golden Mean algorithm.

9. The method of claim 1, wherein the characteristics of the ball comprise magnitude of velocity, direction of velocity, magnitude of spin, direction of spin.

10. The method of claim 9, wherein the direction of velocity is defined as angles relative to an orthogonal gravity oriented coordinate system.

11. The method of claim 9, wherein the direction of spin is defined as components of spin about an orthogonal axis.

12. The method of claim 1, wherein the dots have a thickness of less than about 0.001 inches.

13. The method of claim 1, where in the diffuse dots are pad printed or inkjet printed on the ball.

* * * * *